US006478313B1

(12) United States Patent
Gray

(10) Patent No.: US 6,478,313 B1
(45) Date of Patent: Nov. 12, 2002

(54) WHEEL SUSPENSION SYSTEM FOR IN-LINE ROLLER SKATE

(76) Inventor: Todd D. Gray, 6-81 Somerset St. W., Ottawa, Ontario (CA), K2P 0H3

( * ) Notice: Subject to any disclaimer, the term of this patent is extended or adjusted under 35 U.S.C. 154(b) by 0 days.

(21) Appl. No.: 09/627,200

(22) Filed: Jul. 27, 2000

(30) Foreign Application Priority Data

Jul. 27, 1999 (CA) ..... 2279693

(51) Int. Cl.[7] ..... A63C 17/06
(52) U.S. Cl. ..... 280/11.223; 280/11.27
(58) Field of Search ..... 280/11.27, 11.28, 280/11.221, 11.223, 11.225, 11.231, 11.232, 842

(56) References Cited

U.S. PATENT DOCUMENTS

| | | | | | |
|---|---|---|---|---|---|
| 4,272,090 | A | * | 6/1981 | Wheat | 280/11.28 |
| 5,135,244 | A | * | 8/1992 | Allison | 280/11.28 |
| 5,342,071 | A | * | 8/1994 | Soo | 280/11.28 |
| 5,486,011 | A | * | 1/1996 | Nelson | 280/11.28 |
| 5,582,418 | A | | 12/1996 | Closser | |
| 5,690,344 | A | * | 11/1997 | Chen | 280/11.28 |
| 5,704,620 | A | | 1/1998 | Oliemans et al. | |
| 5,791,665 | A | * | 8/1998 | Mayer II | 280/11.27 |
| 5,931,480 | A | * | 8/1999 | Schroeder | 280/11.28 |
| 6,029,984 | A | * | 2/2000 | Pivotto | 280/11.28 |
| 6,045,142 | A | | 4/2000 | Andrich | |
| 6,196,557 | B1 | * | 3/2001 | Gerard | 280/11.27 |
| 6,227,551 | B1 | * | 5/2001 | Roy | 280/11.223 |
| 6,375,198 | B1 | * | 4/2002 | Caeran et al. | 280/11.221 |

FOREIGN PATENT DOCUMENTS

| | | | | |
|---|---|---|---|---|
| WO | 93/12846 | * | 7/1993 | 280/11.28 |
| WO | 93/12847 | * | 7/1993 | 280/11.28 |

* cited by examiner

*Primary Examiner*—Frank Vanaman
(74) *Attorney, Agent, or Firm*—Alvin R. Wirthlin; Akin Gump Strauss Hauer & Feld, LLP

(57) ABSTRACT

There is provided a suspension for the wheels of an in-line roller skate, the suspension comprising a frame connectable to the boot of the skate, the frame having a pair of parallel spaced-apart rails extending in the longitudinal direction of the skate, a bogey for supporting at least one of the skate's wheels, the bogey being suspended to be pivotable about a horizontal axis relative to the frame, and beams for supporting the skate's leading and trailing wheels, pairs of the beams being pivotably connected at one of their ends to the bogey, rotatably supporting one of the wheels at the other of their ends, and being pivotably connected to respective rails of the frame member at a point intermediate the two ends of the beams.

8 Claims, 9 Drawing Sheets

WHEEL SUSPENSION SYSTEM FOR IN-LINE ROLLER SKATE

FIELD OF THE INVENTION

The present invention relates to in-line roller skates and more particularly to an adaptive wheel suspension system that permits the skate's wheels to deflect in the vertical plane.

BACKGROUND OF THE INVENTION

In-line roller skates are well known in the art. The typical skate comprises a boot portion and a chassis connected to the boot's sole for mounting typically four longitudinally aligned wheels. The wheels' axles are rigidly mounted to the chassis and as a result transmit considerable shock and vibration to the skater, with debilitating effects. Two approaches have been taken to shock absorption, one wheel based and the other chassis based. Wheel based solutions include the use of softer wheels (e.g. 72A to 74A durometer) or dual durometer wheels having an inner core of relatively softer material for shock adsorption and enhanced rebound. Chassis based solutions involve the use of mounts that permit some vertical movement of the wheels or the use of a shock absorber between the wheels and the boot, or a combination of both.

Soft wheels provide greater comfort but at the expense of speed. Dual durometer wheels are effective, but the amount of shock adsorption is nevertheless limited. Chassis that allow the wheels to deflect vertically are known, for example from U.S. Pat. Nos. 5,582,418, 5,704,620 and 6,045,142. Each of these chassis also incorporate some sort of resilient shock absorbers such as springs in the case of U.S. Pat. Nos. 5,582,418 and 5,704,620 and rubber bumpers 26 and 26' in the case of U.S. Pat. No. 6,045,142. Earlier chassis solutions have gained limited commercial acceptance. Their complicated structure makes them expensive, failure prone and heavy. As well, the manner in which the wheels are suspended limits their adaptability to irregularities in the surface being traversed. U.S. Pat. No. 5,704,620 teaches a suspension based on an elliptical spring that allows the wheels to deflect independently, but the overall suspension is complicated and vulnerable given the abuse such skates normally receive. In U.S. Pat. No. 5,582,418, the wheels are bogeyed, but into front and back pairs, which limits flexibility, particularly during maneuvers, when independent movement particularly of the front and back wheels relative to the two interior wheels is desirable.

SUMMARY OF THE INVENTION

The present invention provides an improved chassis for an in-line roller skate with a suspension for the wheels that permits a greater degree of independent movement for each wheel to reduce shock and increase stability and maneuverability, while at the same time minimizing the number of wear and maintenance susceptible parts.

Accordingly, It Is an object of the present invention to provide a wheel suspension system that obviates and mitigates from the disadvantages of the prior art .

It is a further advantage of the present invention to provide a wheel suspension system that reduces shock and vibration without the use of resilient shock absorbing means.

It is a further object of the present invention to provide a wheel supporting suspension that is adaptive to irregularities in the skating surface.

According to the present invention then, there is provided a suspension for the wheels of an in-line roller skate, comprising a frame member connectable to the boot of the skate, said frame member having a pair of parallel spaced apart rails extending in the longitudinal direction of the skate; a bogey for supporting at least one of the skate's wheels, the bogey being suspended to be pivotable about a horizontal axis relative to said frame member; and beam members for supporting the skate's leading and trailing wheels, pairs of said beam members being pivotably connected at one end thereof to said bogey, rotatably supporting one of said wheels adjacent the other end thereof and being pivotably connected to respective ones of said rail at a point intermediate said ends of said beam members.

BRIEF DESCRIPTION OF THE DRAWINGS

Preferred embodiments of the present invention will now be described in greater detail and will be better understood when read in conjunction with the following drawings in which.

DETAILED DESCRIPTION

Figure 1:
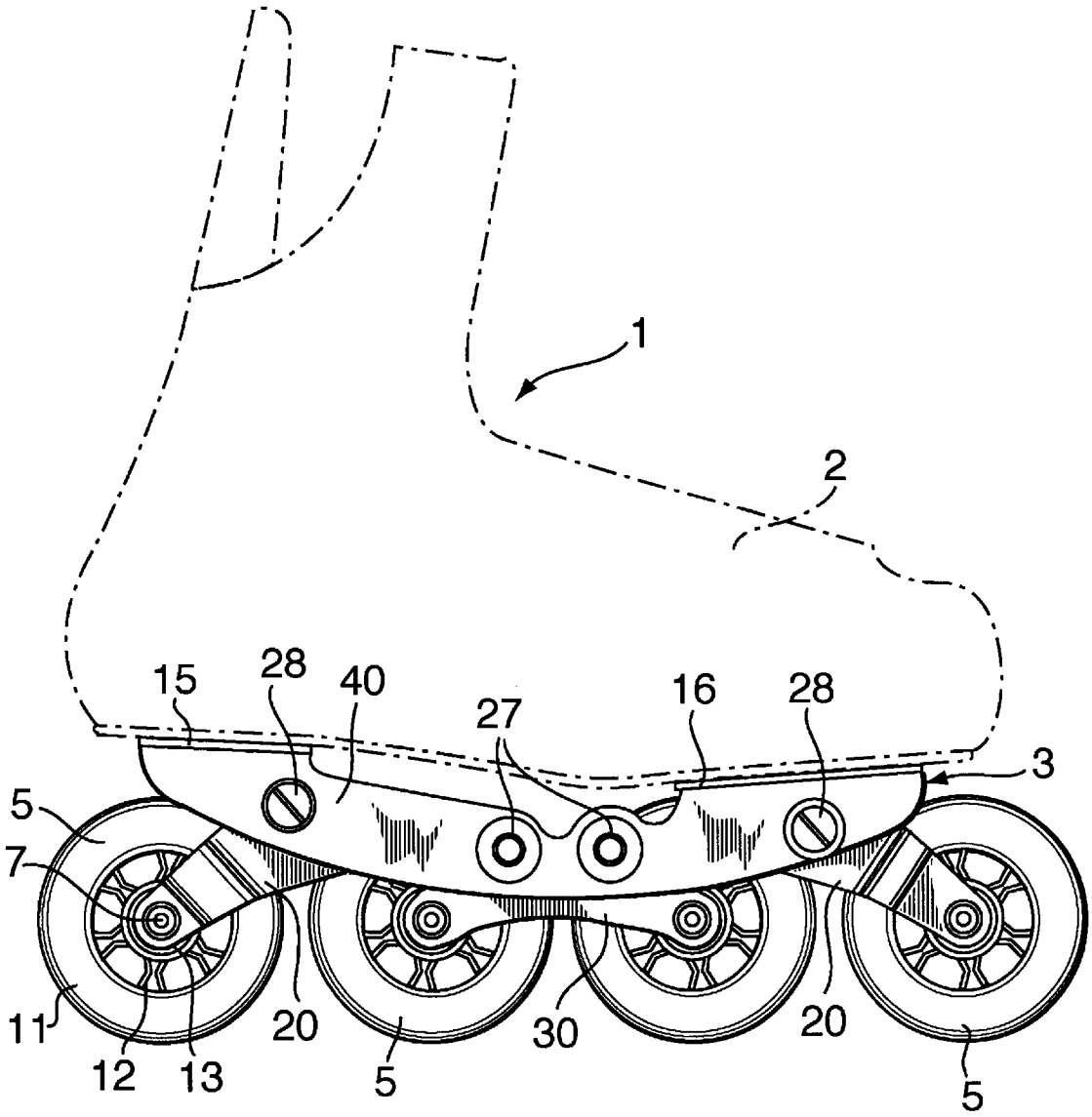
FIG. 1 is a side elevational view of an in-line roller skate with the present wheel suspension system.

With reference to FIG. 1, the present invention provides an in-line roller skate 1 having a boot 2 and a chassis 3 connected to the boot for supporting the usual compliment of four longitudinally aligned wheels 5. In to embodiment shown, the wheels are connected to the chassis in the usual manner using countersunk axle bolts 7 that thread into an axle pin (not shown) extending through the wheel. The wheels themselves may also be conventional consisting of an outer tire 11, a hub 12 and a bearing assembly 13 disposed annularly between the axle pin and the hub which allows the wheel to rotate freely.

In the embodiment shown, the chassis additionally includes a heel plate 15 and a toe plate 16 for connecting the chassis to the sole of boot 2 using rivets, screws or other fastening means.

The structure of the wheels, their mounting for rotation and the connection of the chassis to the boot are all conventional and will not therefore be described in further detail.

The present suspension system includes three principal components, namely a beam 20 for mounting each of the front and rear wheels, a bogey 30 for mounting the two inner wheels and a frame 40 that supports the beams and bogeys and which is adapted by means of the heel and toe plates for connection to the boot. The beam and the bogey are paired on opposite sides of the wheels and are mirror images of one another in shape and size.

Figure 2:
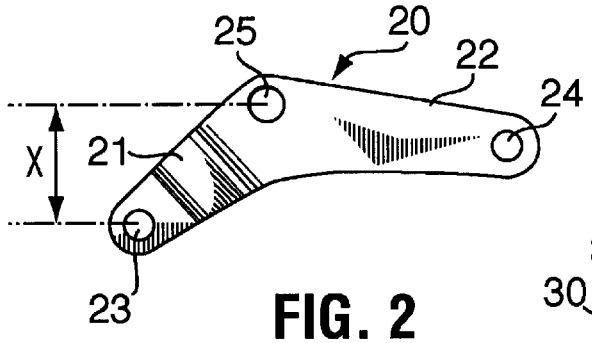
FIG. 2 is a side elevational view of a beam member forming part of the suspension.

Beam 20 is shown in FIG. 2. The beam shown is the one located at the front of the skate to support the leading wheel. The beam used at the rear of the skate will usually be a mirror image in shape and size although this is neither essential nor necessary.

Beam 20 is dog-legged in shape defining two arms 21 and 22. A countersunk hole 23 is formed at the end of arm 21 for an axle bolt that connects the wheel. Another hole 24 is formed adjacent the end of arm 22, As will be described in greater detail below, this hole is for a pin member 27 that pivotably connects the beam to bogey 30 as shown most clearly in FIG. 5. At the beam's apex is a third hole 25 for another pin member 28 that pivotably connects the beam to frame 40, as will also be described in greater detail below.

Figure 5:
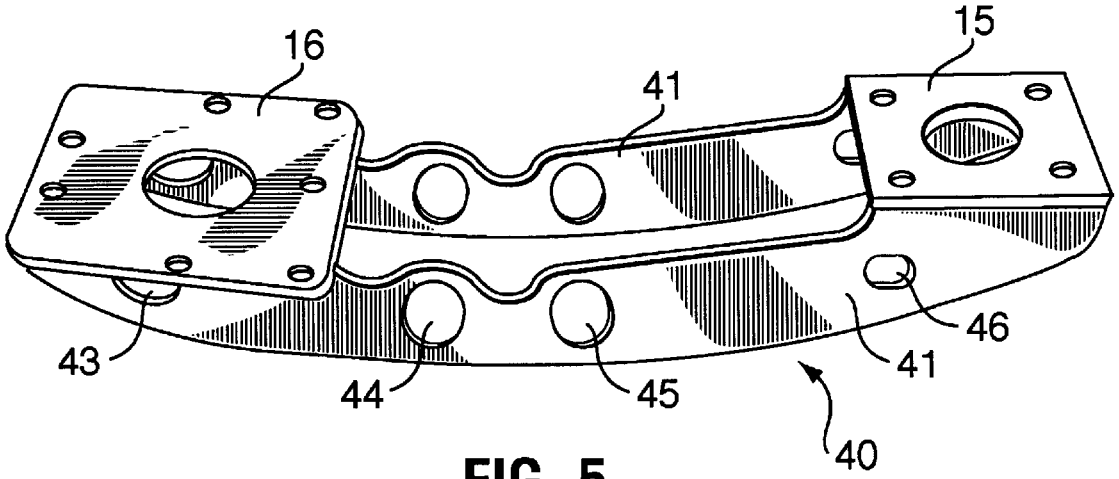
FIG. 5 is a perspective view of the frame member of FIG. 4.

The orthogonal distance X between a horizontal center line drawn through holes 23 and 25 is selected to provide adequate clearance between the wheel and the chassis and so that the axial center line of the wheel's axle aligns with the axially center line of the three remaining wheels when arranged on a flat surface as shown in FIG. 5.

Figure 3:
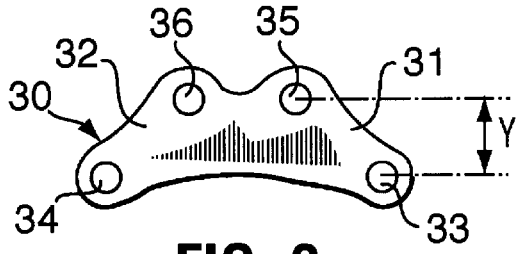
FIG. 3 is a side elevational view of a bogey member forming part of the suspension.

Bogey 30 is shown in FIG. 3. The bogey is formed with oppositely extending arms 31 and 32. Adjacent the ends of each arms are countersunk holes 33 and 34 for the axle bolts connecting the skate's two inner wheels to the bogey. The bogey includes two additional holes 35 and 36. Hole 35 receives the pin 27 used to connect leading beam 20 and hole 36 receives the other pin 27 used to connect trailing beam 30 to the bogey.

The orthogonal distance Y between horizontal center lines drawn through holes 35 and 36 and holes 33 and 34, respectively, is chosen to provide adequate clearance between the wheels connected to the bogey and the chassis and so that the axles of the two bogey wheels align horizontally with the axles of the leading and trailing wheels when the skate is on a flat surface.

Figure 4:
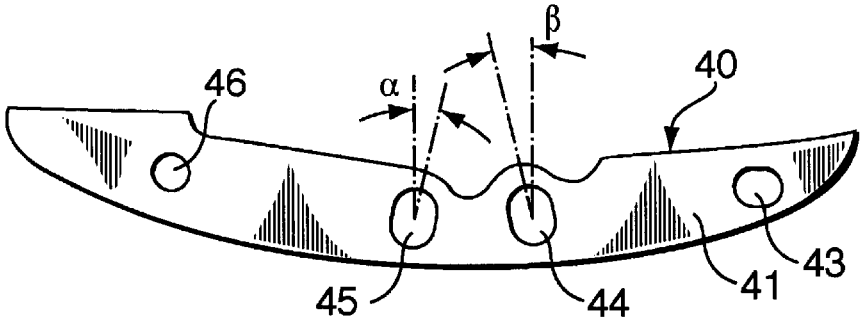
FIG. 4 is a side elevational view of a frame member forming part of the present suspension.

Frame 40 is shown in FIGS. 4 and 5. The frame consists of a pair of parallel, horizontally aligned mirror image rails 41 maintained in fixed spaced apart relationship by toe plate 18 at the front and heel plate 15 at the rear. The two plates are fixedly connected to the rails such as by welding if the rails are made of metal, or formed integrally therewith if the frame is injection molded. Spacing between the rails is also maintained by pins 28 used to pivotably connect beams 20 to the rails as will be described in greater detail below.

To enable the present suspension to function as the wheels deflect vertically alignment when traversing irregularities in the skating surface, the beam and bogey mechanism must be able to lengthen and shorten in response. This is accommodated by obround apertures or slots in the rails which allow the pins that connect the bogeys and beams to move in response to vertical movement of the wheels. The length of these slots limits the amount of deflection so that the wheels are not allowed to move into frictional contact with the bottom of the boot or with one another.

With particular reference to FIG. 4, each rail is formed with four apertures with the apertures in one rail having the same dimensions and orientation and being in horizontal axial alignment with the apertures in the other. The apertures in one rail only will therefore be described in detail.

Forwardmost aperture 43 is an obround slot with its longitudinal axis aligned in the horizontal plane of the frame. The aperture is dimensioned to allow the pin 28 connecting beam 20 to side rail 41 approximately 1.6 millimeters of movement.

Aperture 44 is also an obround slot and is oriented with its longer axis aligned at an angle $\beta$ of approximately 3° to the vertical tilting towards the front of the frame. The aperture is dimensioned to allow the pin 27 connecting bogey 30 to the rail approximately 5 millimeters of movement.

Aperture 45 is again an obround slot with its longer axis aligned at an angle $\alpha$ of approximately 3° to the vertical tilting towards the front of the frame. The aperture is dimensioned to allow the pin 27 connecting bogey 30 to the frame approximately 5 millimeters of movement.

Finally, aperture 46 adjacent the rear of the frame is circular in shape and as a result, the pin 28 connecting rear beam 20 permits rotation but does not itself move laterally in any direction.

As will be appreciated, the skate's leading wheel pivots around pin 28 in aperture 43, the second wheel pivots around the pin 27 in aperture 44, the third wheel pivots around the pin 27 in aperture 45 and the trailing fourth wheel pivots around pin 28 in aperture 46. Each wheel is allowed a maximum radial motion of approximately 5° but this figure may be varied for different uses and construction of the suspension.

Figure 9:
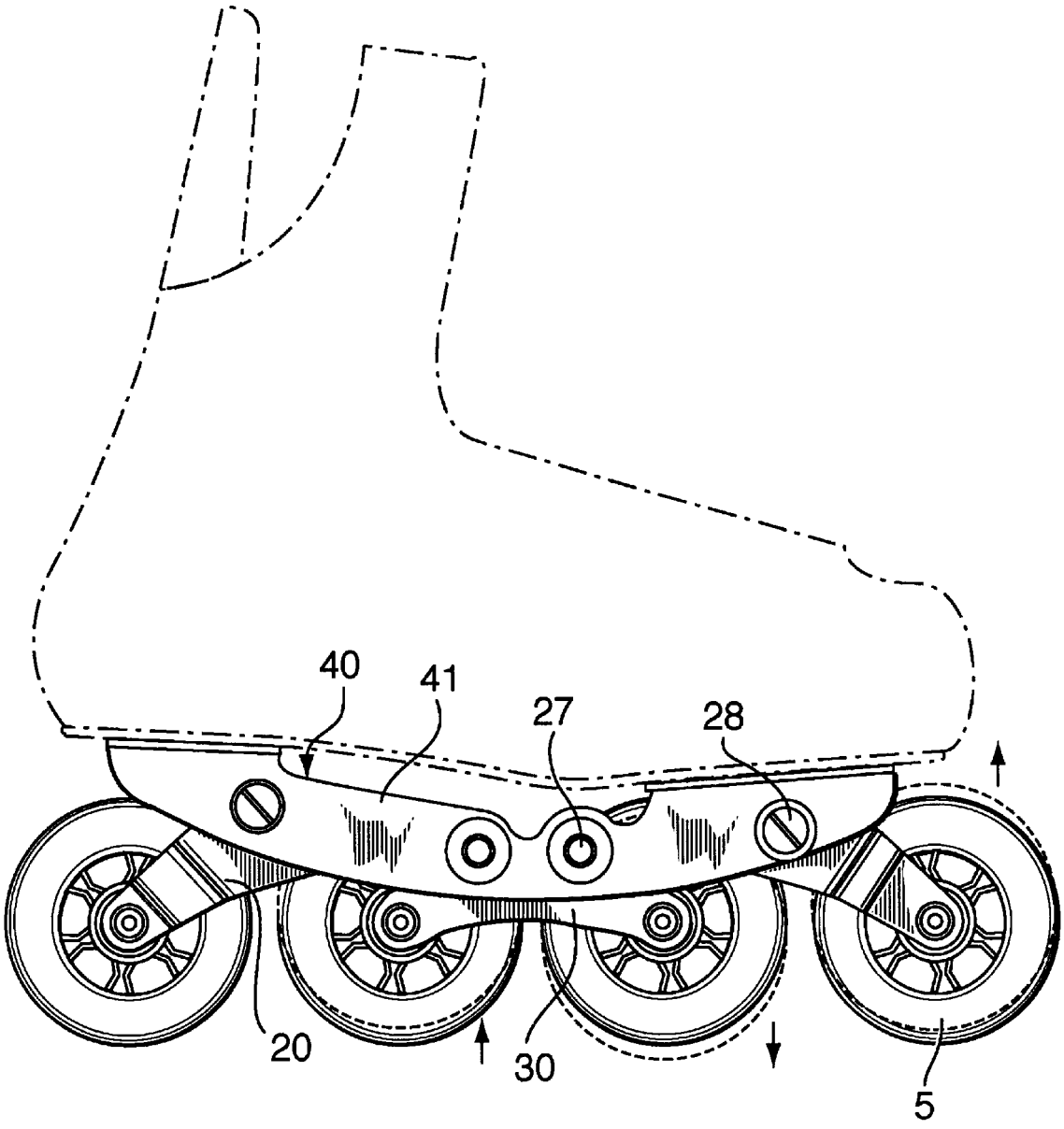
FIG. 9 is a side elevational view of the suspension in operation.

Reference will now be made to FIG. 9 which schematically shows pins 27 and 28 in their respective apertures for greater clarity.

As the front wheel is deflected upwardly, pin 28 in slot 43 moves rearwardly, pin 27 in slot 44 moves downwardly and pin 27 in slot 45 moves upwardly. As the second wheel encounters the surface irregularity, it moves upwardly and the first and third wheels move downwardly. In this way, the wheels'sequence over the surface irregularity to minimize shock transmission to the skater. As well, during manoeuvres the wheels automatically adjust themselves vertically depending on the angle of the skate relative to the ground. For example, when the skater is leaning into a turn, the two inner wheels on bogey 30 lower and the two outer wheels on beams 20 rise to allow a tighter turn and to provide more wheel contact with the ground for greater speed.

The differences in the shape and orientation of apertures 43, 44, 45 and 46 results in the two bogey wheels moving in response to a deflection of either the leading or trailing wheel, however, a deflection of the leading wheel does not result in any responsive deflection of the trailing wheel, and vice versa.

Figure 6:
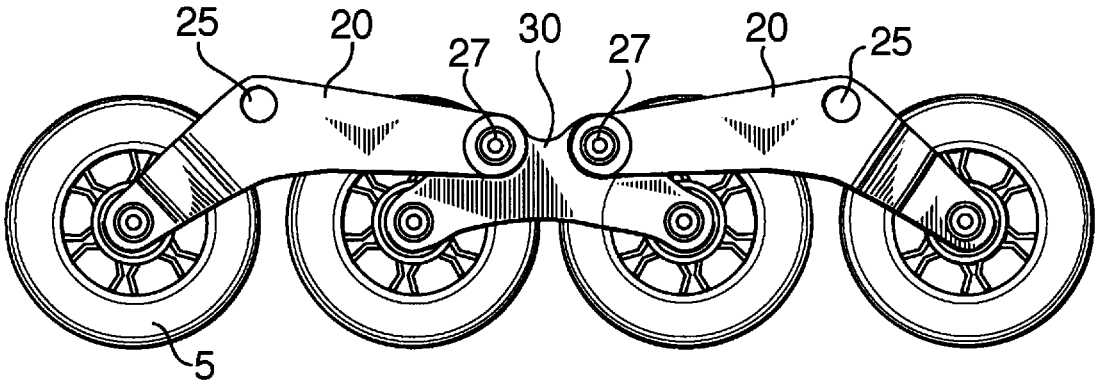
FIG. 6 is a side elevational view of the beam and bogey members assembled together.
Figure 7:
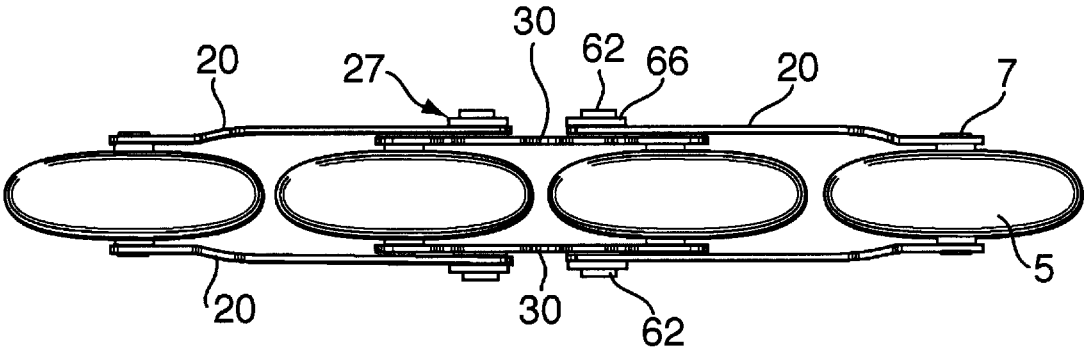
FIG. 7 is a plan view of the sub-assembly of FIG. 6.

Reference will now be made to FIGS. 1 and 6 to 8 for purposes of describing the assembly of the suspension in greater detail. Reference will be made first to FIGS. 6 and 7 showing the sub-assembly of beams 20 and bogey 30.

Beams 20 are arranged to the outside of bogey 30 so that apertures 24 align with holes 35 in the bogey for the insertion of pins 27. Each pin 27 consists actually of a number of parts. The first is a spacer bearing 60 shown as a breakaway in FIG. 8. The bearing, which is advantageously made of nylon, teflon or some other durable, low friction material, includes a cylindrical pin 62 and a contiguous flange 63. The pin is inserted first through hole 35 in bogey 30 and then through hole 24 in beam 20 until flange 63 bear against the bogey's side wall. The sleeve is long enough to extend through both the bogey and the beam and into aperture 44 in frame rail 41 as will be described below. The outer diameter of the sleeve is equal to the diameters of holes 35 and 24 to eliminate any play. The diameter of the sleeve is smaller however than either the major or minor diameters of aperture 44 in the rail to that the sleeve can move up and down and, to a lesser extent, from side to side in the aperture. A low friction washer 66 is placed around the sleeve on either side of beam 20.

Figure 8:
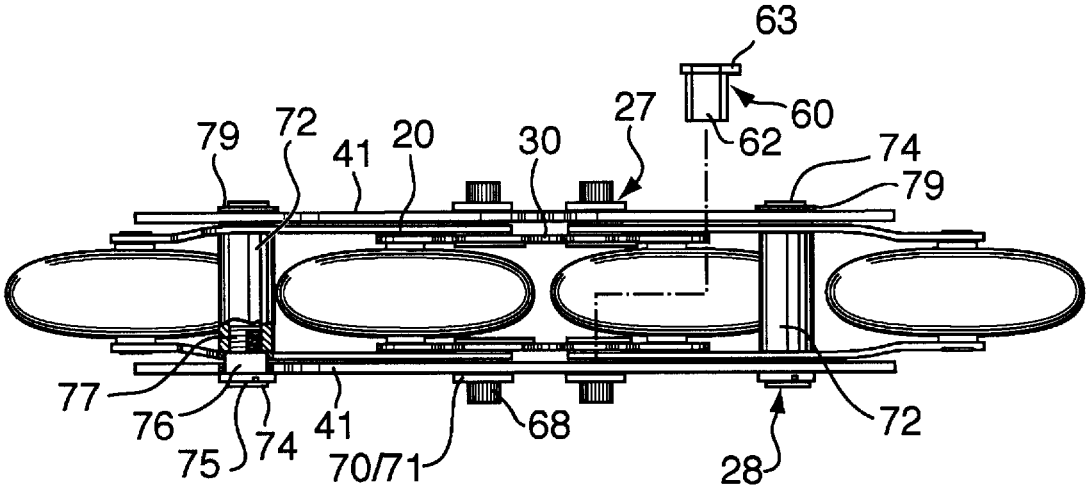
FIG. 8 is a plan view of the beam, bogey and frame members assembled together with the frame's top plates removed for greater clarity.

Reference will now be made to FIGS. 1 and 8 showing the assembly of the beam-bogey sub-assembly to frame 40. In FIG. 8, heel and toe plates 15 and 16 have been removed for greater clarity.

The beam-bogey sub-assembly fits between rails 41 of frame 40. The protruding ends of pins 62 are received into apertures 44 and 45. The pins are each internally threaded for connection to threaded bolts 68. A pair of washers 70 and 71 are disposed around each bolt outside of rail 41. Inner washer 71 is preferably a plastic low friction washer and the outer washer 70 is metallic or otherwise sufficiently strong to withstand compressive loads as bolt 68 is tightened. This arrangement allows bolts 68 to be securely tightened to the pins of spacer bearings 60 but at the same time allows the pins and the bolts to slidably move within the scope permitted by apertures 44 and 45. Bolt 68 and its connection to pin 62 completes each of pins 27.

Holes 25 in beams 20 align with apertures 43 and 48 in rails 41 for the installation of pins 28. As with pins 27, pins 28 are a collection of parts. These include a cylindrical spacer 72, internally threaded at each of its ends, which is placed between beams 20 in alignment with holes 25. Shoulder bolts 74 are inserted through apertures 43/46 in rails 41 and threaded into the ends of the spacers. The shoulder bolts include a flanged head 75, a cylindrical shoulder 76 and a threaded pin 77. The diameter of shoulder 76 is substantially equal to the diameter of circular aperture 46 in rail 41 so there is no play in the connection which is therefore limited to pivoting movement. The diameter of the shoulder is also substantially equal to the lesser diameter of slot 43 in the rail to permit the shoulder bolts to move in the longitudinal direction of these apertures, but not laterally relative thereto. Low friction washers 79 are placed as shown in FIG. 8 to allow the shoulder bolts to tighten securely while still permitting them to slidably move in slots 43.

The specific means described above for connecting the components of the suspension together are exemplary in nature and other means for accomplishing the same end will occur to those skilled in the art.

An alternative suspension is shown in FIGS. 13 to 17. As before, the suspension comprises three principle components, a beam 120 shown in FIG. 14, a bogey 130 shown in FIG. 15 and a frame 140 shown in FIG. 16. The principles of operation and function of this embodiment are similar to those of the previously described embodiment and the following description will therefore be confined to the differences between the two.

Figure 14:
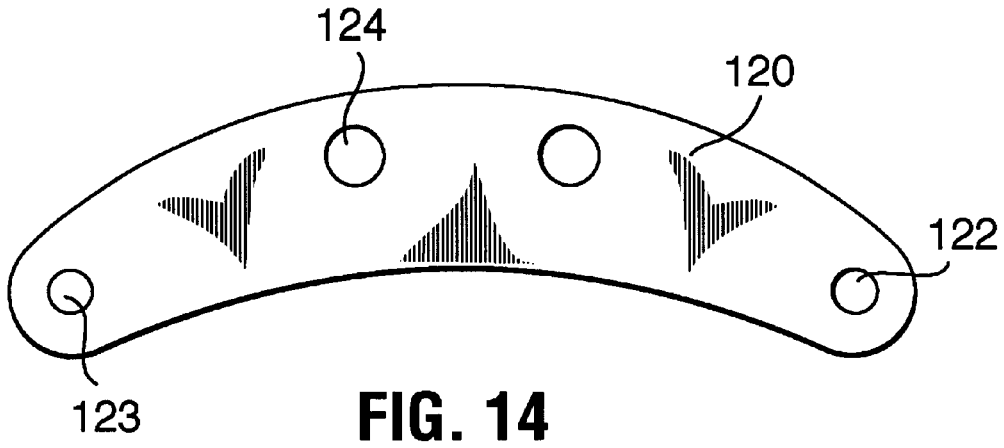
FIG. 14 is a side elevational view of the beam of the suspension of FIG. 13.

With reference to FIG. 14, each beam 120 is arcuate in shape and has a first hole 122 for a wheel mounting axle bolt, a second hole 123 for a pivotable connection to bogey 130 and at least one additional (third) hole 124 for a shoulder bolt/bearing sleeve pin 128 used to pivotably connect each beam to frame 140.

Figure 15:
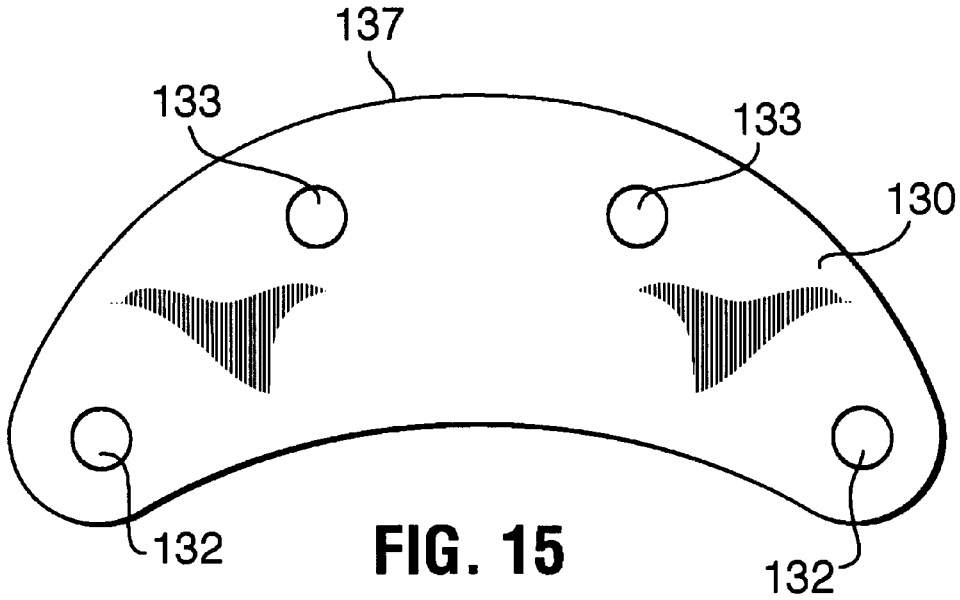
FIG. 15 is a side elevational view of the bogey of the suspension of FIG. 13.

With reference to FIG. 15, the bogey 130 is also arcuate in shape and has two holes 132 for wheel mounting axle bolts, and two additional holes 133 for the pins 127 used to connect the bogey to beams 120.

Figure 16:
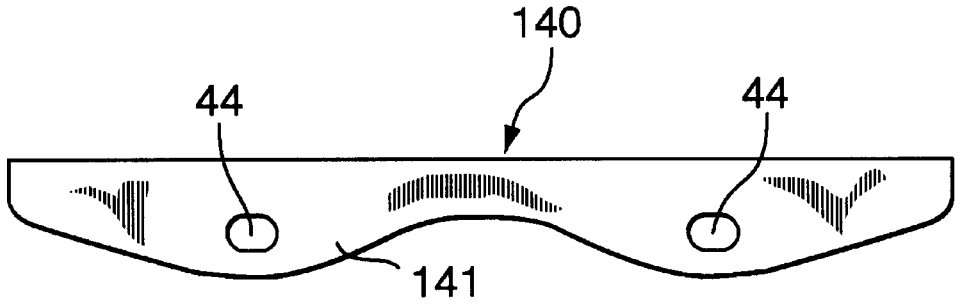
FIG. 16 is a side elevational view of the frame of the suspension of FIG. 13.
Figure 17:
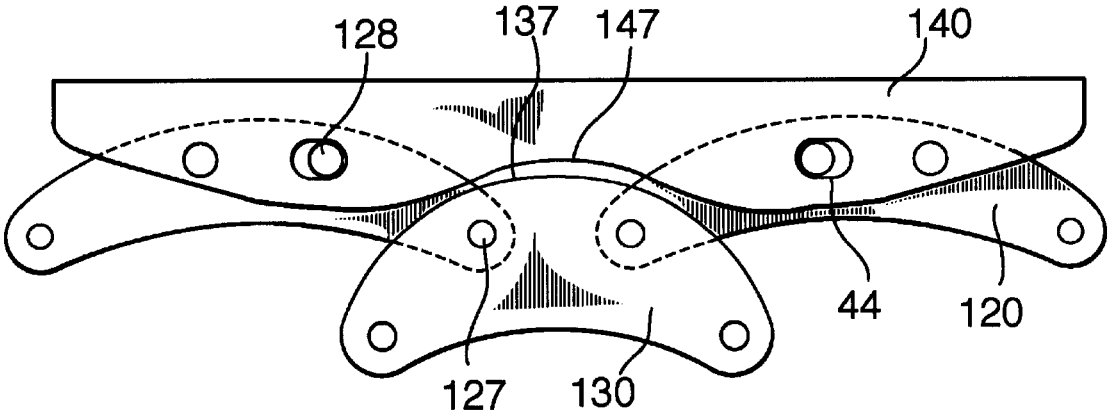
FIG. 17 is a side elevational view of the suspension of FIG. 13 in operation.

With reference to FIG. 16, frame 140, like frame 140, comprises two parallel, spaced-apart rails 141 held in fixed relationship one to the other by means of heel and toe plates (not shown). Each rail includes a pair of slots 44 that accommodate movement of the shoulder bolts used to connect beams 120. This function is best illustrated in the schematical representation of FIG. 17. The vertical displacement of the wheels in this embodiment is limited by contact between upper curved surface 137 of bogey 130 with the lower curved surface 147 of rail 141 as best shown again with reference to FIG. 17.

Figure 10:
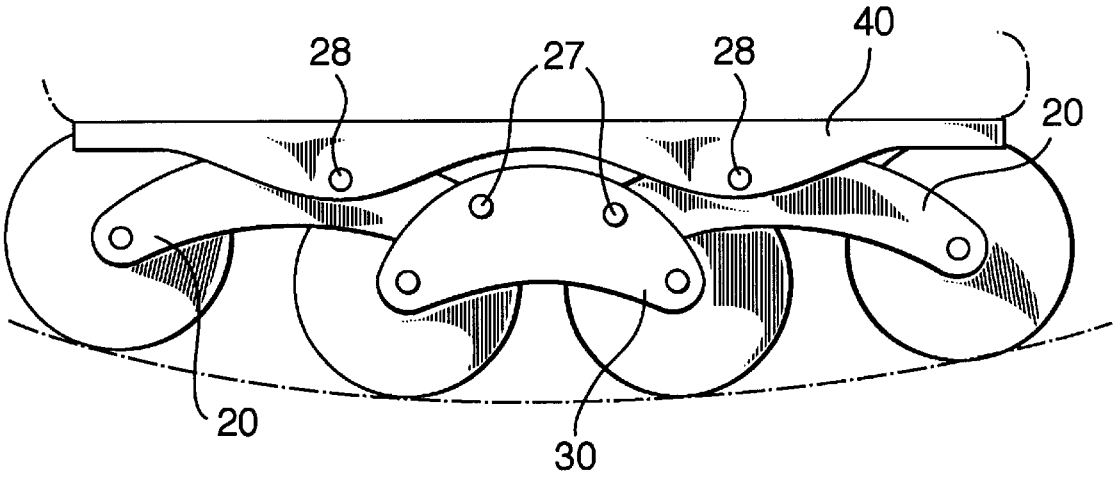
FIG. 10 is a side elevational view of the suspension traversing a concave surface.
Figure 11:
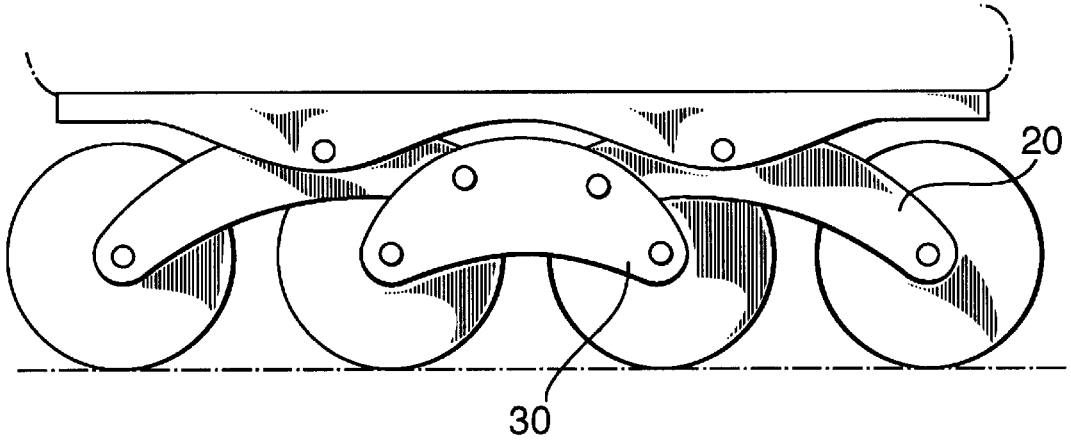
FIG. 11 is a side elevational view of the suspension traversing a flat surface.
Figure 12:
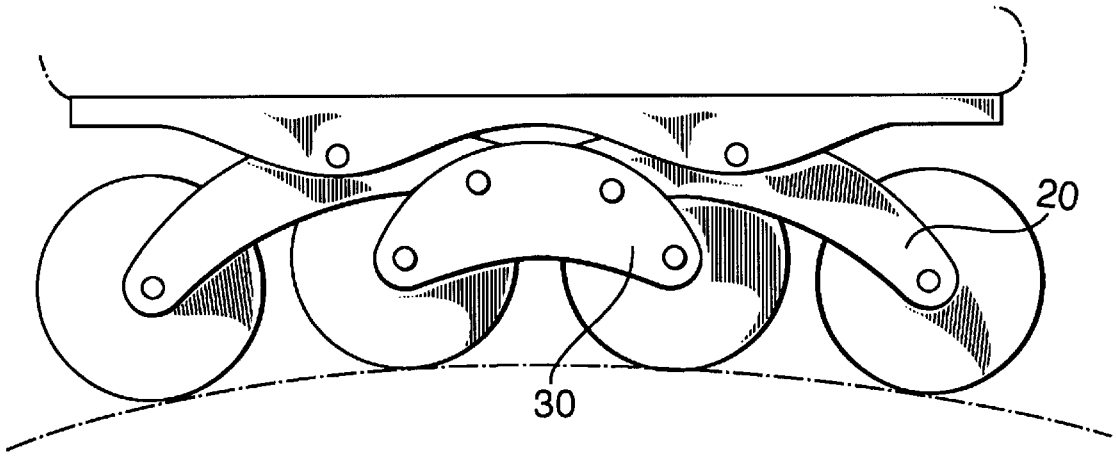
FIG. 12 is a side elevational view of the suspension traversing a convex surface.
Figure 13:
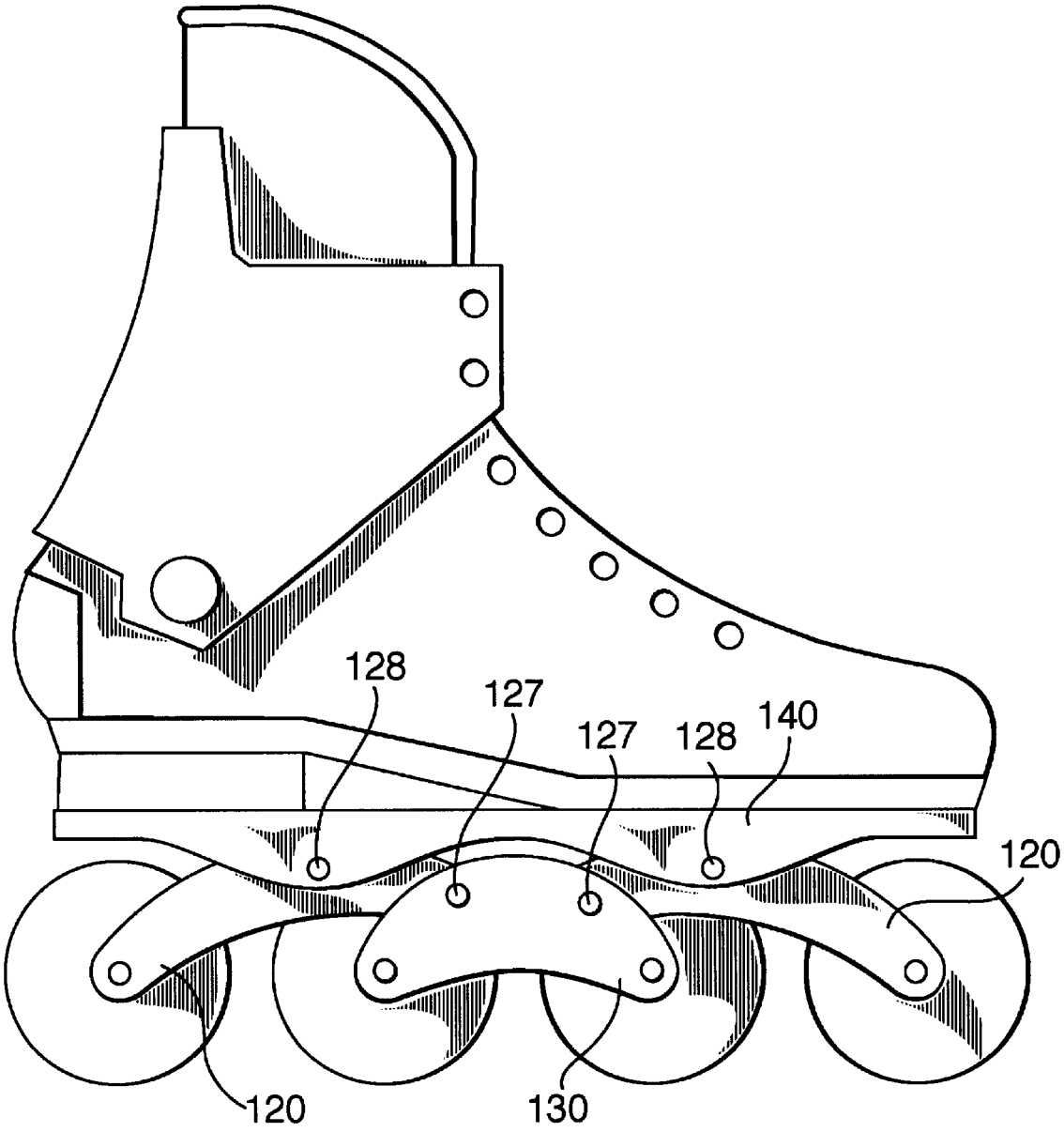
FIG. 13 is a side elevational view of an alternative wheel suspension system.

FIGS. 10 to 12 show how the present suspension, including the embodiments of both FIGS. 1 and 13, adapt to concave, flax and convex skating surfaces.

Figure 18:
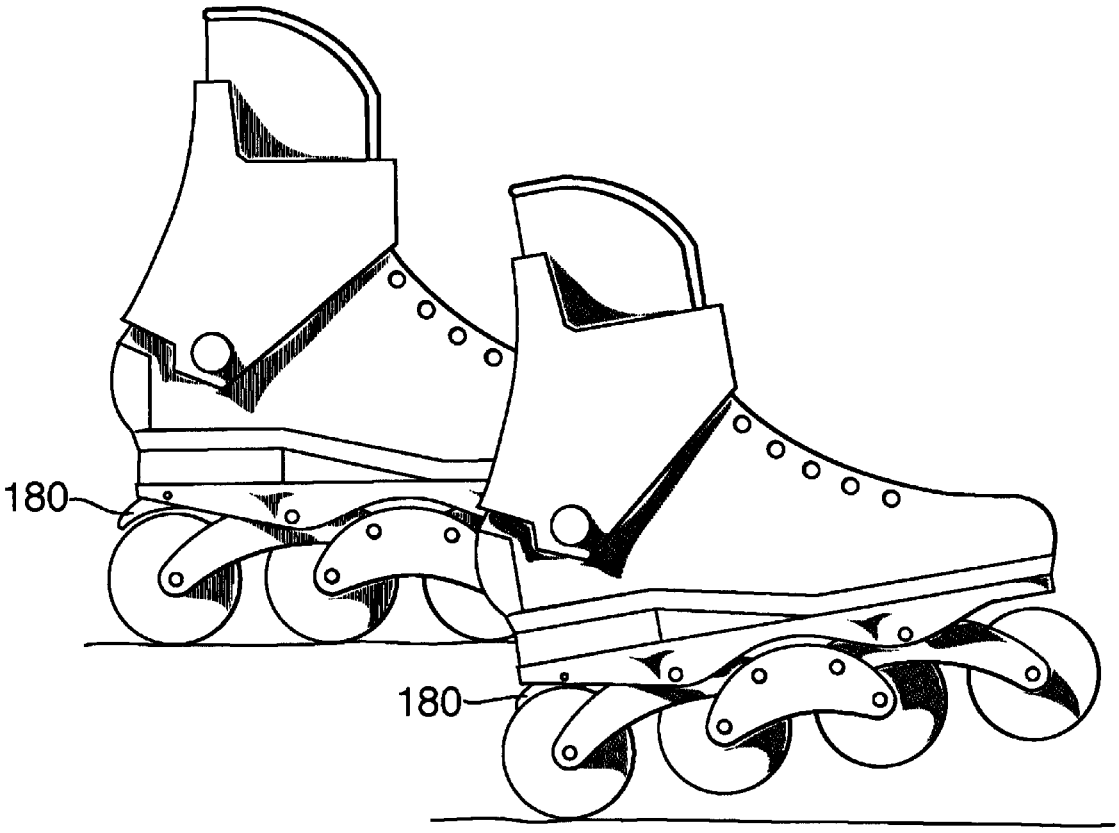
FIG. 18 is a side elevational view of the slot of FIG. 13 with a braking mechanism.
Figure 19:
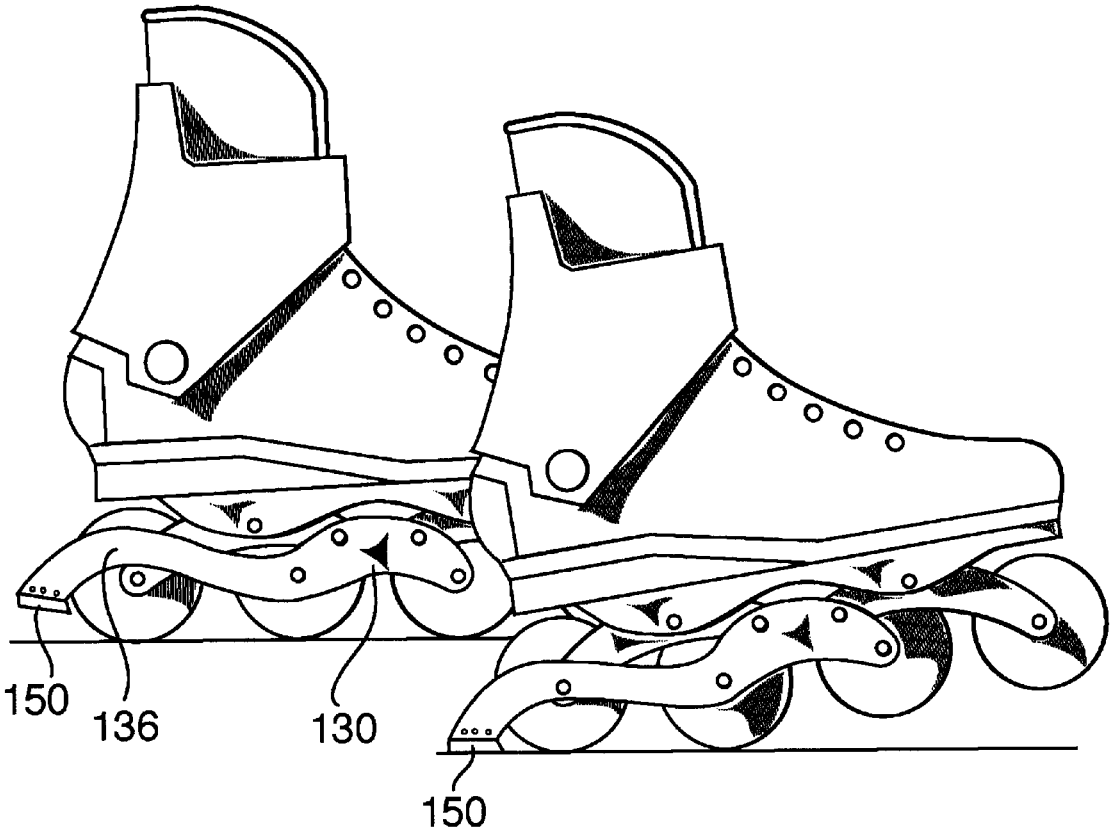
FIG. 19 is a side elevational view of the slot of FIG. 13 with an alternative braking mechanism.

Skates fitted with the suspension of FIG. 1 can include a conventional heel brake. An alternative braking mechanism particularly adapted to the embodiment of FIG. 13 is shown with reference to FIG. 18. When the skater elevates the toe of the skate and weights the rear wheels, the two front wheels become elevated, allowing the skater to manoeuver on the two rear wheels. By exerting more pressure on the rear wheels, a brake pad 180 mounted under the heel of the boot can engage the rearmost wheel. This action is reversed when the heel of the boot is raised and the toe is depressed. Thus, it may be feasible to have both toe and heel brakes. A further alternative for use with the embodiments of FIGS. 1 and 13 is shown in FIG. 19. Specifically, bogey 130 is extended to include a levered arm 136 with a brake pad 150 situated to engage the skating surface when the skate is tilted rearward.

The present suspension is readily adapted to speed skates or ski simulators. For example, the wheel supporting legs of beams 20/120 can be elongated as desired to locate the leading and trailing wheels well forward and well aft of the boot.

Other advantages of the present suspension include its automatic adjustment to wheels of different diameter. For example, some hockey players prefer that the two rear wheels have a larger diameter than the two forward wheels. The present suspension adjusts to the two sizes automatically. The suspension is also adjustable for skaters of different weight. Specifically, pins 27 and 28 can be additionally torqued for relatively heavy skaters and loosened for lighter skaters. Tightening will stiffen the suspension to improve its shock adsorbing characteristics for larger skaters and loosening will allow the suspension to flex more easily for lighter skaters. Skaters can therefore adjust the friction in the suspension until it suits their preferences.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

The embodiments of the invention in which an exclusive property or privilege is claimed are defined as follows:

1. A suspension for the wheels of an in-line roller skate, comprising:

a frame member connectable to a boot of the skate, said frame member having a pair of parallel, spaced apart, longitudinally extending rails;

a bogey for directly supporting thereon at least one of the skate's wheels, the bogey being suspended to be pivotable about a horizontal axis relative to said frame member; and beam members for supporting the skate's leading and trailing wheels, pairs of said beam members being pivotably connected at one end thereof to said bogey, rotatably supporting one of said wheels adjacent the other end thereof and being pivotably connected to respective ones of said rails at a point intermediate said ends of said beam members.

2. The suspension of claim 1 wherein said beam members for supporting the skate's leading wheel are respectively connected to said rails for sliding movement substantially longitudinally along said rails.

3. The suspension of claim 2 wherein said bogey is connected to said frame member to be pivotable relative thereto and to be moveable towards and away from said frame member.

4. The suspension of claim 3 wherein said bogey is connected on one side thereof to one of said rails and on the other side thereof to the other of said rails, said connection on each side comprising a pair of horizontally spaced apart pin members, each of said pin members being slidably moveable in respective substantially vertical slots in said rails whereby said bogey can both pivot and move up and down relative to said frame member.

5. The suspension of claim 4 wherein the forwardmost pin member of said pair of pin members on each side of said bogey connect said beam members that support the skate's leading wheel to said bogey, and wherein the rearmost pin member of said pair of pin members on each side of said bogey connect said beam members that support the skate's trailing wheel to said bogey.

6. The suspension of claim 5 wherein said bogey supports at least two wheels thereon, one of said wheels being supported forwardly of said forwardmost of said pin members and the other of said wheels being supported rearwardly of said rearmost of said pin members.

7. The suspension of claim 6 wherein said beam members supporting the skate's leading wheel are each pivotably connected to a respective rail by a pin member, each rail having a slot formed therein for said pin member to permit said sliding movement of said beam members.

8. The suspension of claim 7 wherein said beam members supporting the skate's trailing wheel are each pivotably connected to a respective rail by a pin member, each rail having an aperture formed therein for receiving said pin member.

* * * * *